United States Patent [19]

Spoolstra

[11] Patent Number: 4,618,095

[45] Date of Patent: Oct. 21, 1986

[54] ELECTROMAGNETIC UNIT FUEL INJECTOR WITH PORT ASSIST SPILLDOWN

[75] Inventor: Gregg R. Spoolstra, Hudsonville, Mich.

[73] Assignee: General Motors Corporation, Detroit, Mich.

[21] Appl. No.: 751,004

[22] Filed: Jul. 2, 1985

[51] Int. Cl.[4] ..... F02M 47/00

[52] U.S. Cl. ..... 239/90; 239/93; 239/95; 239/124; 239/585

[58] Field of Search ..... 239/88–91, 239/93, 95, 124, 125, 127, 585

[56] References Cited

U.S. PATENT DOCUMENTS

| | | | |
|---|---|---|---|
| 3,566,849 | 3/1971 | Frick | 123/140 |
| 4,129,253 | 12/1978 | Bader et al. | 239/96 |
| 4,392,612 | 7/1983 | Deckard et al. | 239/88 |
| 4,402,456 | 9/1983 | Schneider | 239/91 |
| 4,408,718 | 10/1983 | Wich | 239/88 |
| 4,418,867 | 12/1983 | Sisson | 239/125 |
| 4,425,894 | 1/1984 | Kato et al. | 239/88 |
| 4,463,900 | 8/1984 | Wich | 239/88 |
| 4,470,545 | 9/1984 | Deckard et al. | 239/88 |
| 4,482,094 | 11/1984 | Knape | 239/88 |
| 4,485,969 | 12/1984 | Deckard et al. | 239/88 |
| 4,503,825 | 3/1985 | Schneider | 239/95 |
| 4,527,737 | 7/1985 | Deckard | 239/89 |
| 4,531,672 | 7/1985 | Smith | 239/89 |
| 4,550,875 | 11/1985 | Teerman et al. | 239/125 |

OTHER PUBLICATIONS

Pending U.S. patent application Ser. No. 595,694 filed Apr. 2, 1984 in the names of John I. Deckard; Richard F. Teerman; and, Russell H. Bosch.

Pending U.S. patent application Ser. No. 642,389 filed Aug. 20, 1984 in the name of John I. Deckard.

*Primary Examiner*—Joseph F. Peters, Jr.

*Assistant Examiner*—Michael J. Forman

*Attorney, Agent, or Firm*—Arthur N. Krein

[57] ABSTRACT

An electromagnetic unit fuel injector, of the type having a pump including a pump cylinder and an externally actuated plunger and having a solenoid actuated, control valve for normally controlling the spill, inject, spill cycle during a pump stroke of the plunger, has a mechanical spill arrangement associated with the plunger and cylinder to assist in the spill flow of fuel above a predetermined high speed engine operating condition.

3 Claims, 3 Drawing Figures

ELECTROMAGNETIC UNIT FUEL INJECTOR WITH PORT ASSIST SPILLDOWN

This invention relates to unit fuel injectors of the type used to inject fuel into the cylinders of a diesel engine and, in particular, to an electromagnetic unit fuel injector having a solenoid controlled, normally open, control valve therein for normally controlling a spill, inject, spill cycle during a pump stroke of the plunger in a cylinder therein, with the plunger and associate cylinder also having a spill port means associated therewith.

DESCRIPTION OF THE PRIOR ART

Unit fuel injectors, of the so-called jerk type, are commonly used to pressure inject liquid fuel into an associate cylinder of a diesel engine As is well known, such a unit injector includes a pump in the form of a plunger and bushing which is actuated, for example, by an engine driven cam whereby to pressurize fuel to a suitable high pressure so as to effect the unseating of a pressure actuated injection valve in the fuel injection nozzle incorporated into the unit injector.

In one form of such a unit injector, the plunger is provided with helices which cooperate with suitable ports in the bushing whereby to control the pressurization and therefore the injection of fuel during a pump stroke of the plunger In another form of such a unit injector, a solenoid valve is incorporated in the unit injector so as to control, for example, the drainage of fuel from the pump chamber of the unit injector. In this latter type injector, fuel injection is controlled by the energization of the solenoid valve, as desired, during a pump stroke of the plunger whereby to terminate drain flow so as to permit the plunger to then intensify the pressure of fuel to effect unseating of the injection valve of the associated fuel injection nozzle. An exemplary embodiment of such an electromagnetic unit fuel injector is disclosed, for example, in U.S. Pat. No. 4,129,253 entitled "Electromagnetic Unit Fuel Injector", issued Dec. 12, 1978 to Ernest Bader, Jr., John I. Deckard and Dan B. Kuiper.

In U.S. Pat. Nos. 4,392,612 entitled "Electromagnetic Unit Fuel Injector", issued July 12, 1983 to John I. Deckard and Robert D. Straub and 4,463,900 entitled "Electromagnetic Unit Injector", issued Aug. 2, 1984 to Thomas Wich, both assigned to a common assignee, there are disclosed examples of unit injectors of the type wherein a solenoid actuated normally open, control valve, which can be a pressure balanced valve as shown in the U.S. Pat. No. 4,392,612 or a non-pressure balanced valve as shown in the U.S. Pat. No. 4,463,900, is used to control the spill drain flow of fuel from the pump chamber during a pump stroke of the associate plunger. In such a unit injector, the pump capacity is preselected so as to be substantially greater than the preselected maximum injector output. Fuel injection is initiated during a pump stroke of the plunger by energization of the solenoid to close the control valve so as to block the spill drain flow of fuel from the pump chamber, thus allowing the continued plunger movement to intensify the pressure of fuel to a value to effect unseating of an associated pressure actuated injection valve for the injection of fuel. Upon deenergization of the solenoid, a valve spring effects unseating of the control valve to again allow the spill flow of fuel causing the fuel pressure to drop and thereby to terminate injection.

Thus during each plunger pump stroke, the control valve operates through a spill, inject, spill cycle.

As well known in the art, the solenoid coil of the solenoid assembly in such an electromagnetic unit fuel injector is connected to a suitable source of electrical power via a suitable fuel injector electronic control circuit, such as provided in an onboard computer. Thus such electronic control of a unit type fuel injector, that is, an electromagnetic unit fuel injector, provides excellent injection timing and output flexibility. The electromagnetic or solenoid actuated control valve, operating through computer controlled electrical signals is adapted to provide for a range of injection timing and output that is, in effect, limited only by the pump plunger actuating camshaft design in a given engine application.

However, applicant has now discovered that when attempting to miniaturize such an electromagnetic unit fuel injector for certain engine applications, that due to package size and other constraints such as, for example, the control valve location and high pressure passage sizes and configurations, the high pressure spill path through the annulus shaped flow area defined by the valve seat and the valve seat surface of the control valve, when the latter is at its full open position is inadequate at high engine speeds to permit sufficient spill flow so as to effect a substantially immediate end of fuel injection. This is due to the fact that in a particular engine application, at top engine speed and peak injector output, the real time allowed to inject fuel is significantly reduced from the real time allowed at lower engine speeds because of the higher angular velocity of the camshaft at the higher engine speed. Thus at high engine speeds, fuel which may be injected into the associate combustion chamber after a given point in the combustion process merely results in poor fuel efficiency and yields excessive smoke.

SUMMARY OF THE INVENTION

The present invention provides an electromagnetic unit fuel injector that includes a pump assembly having a plunger reciprocable in a bushing and externally operated as, for example, by an engine driven rocker arm, with flow from the pump chamber during a pump stroke of the plunger being directed to a fuel injection nozzle assembly of the unit that contains a spring biased, pressure actuated injection valve therein for controlling flow out through the spray tip outlets of the injection nozzles. Fuel from the pump chamber can also flow through a passage means, containing a normally open, solenoid actuated, control valve means to a chamber containing fuel as at a relatively low supply pressure. Fuel injection is regulated by the controlled energization of the solenoid actuated control valve so that the valve is operatively positioned to block drain flow as desired from the pump during a portion of the pump stroke of the plunger whereby the plunger is then permitted to intensify the pressure of fuel to a value to effect unseating of the injection valve. Thereafter, upon deenergization of the solenoid, the control valve is again opened for the spill flow of fuel to thereby reduce the pump pressure to a value to again effect seating of the injection valve. In addition the plunger and bushing are provided with a secondary spill passage means axially located so as to assist the solenoid actuated control valve to spill injection pressure at a predetermined high engine operating speed and thus at a point when fuel can no longer be effectively added to the combustion process.

It is therefore a primary object of this invention to provide an improved electromagnetic unit fuel injector that contains a solenoid actuated control valve means for controlling the start and end of fuel injection during a pump stroke of an associate plunger in the pump cylinder which also contains a spill passage means in the plunger and pump cylinder positioned so as to assist the control valve means to terminate injection at a predetermined high engine speed.

Another object of this invention is to provide an improved electromagnetic unit fuel injector that is adapted to be controlled electronically to effect fuel injection timing and output and which also contains a mechanically controlled spill port means positioned in the associate plunger and cylinder of the unit so as to spill injection pressure at the point in the operational engine cylinder combustion cycle at high engine speeds at which fuel can no longer be effectively added to the combustion process.

Still another object of the present invention is to provide an electromagnetic unit fuel injector of the above type which includes features of construction, operation and arrangement, rendering it easy and inexpensive to manufacture and assemble, which is reliable in operation and in other respects suitable for use in production motor vehicle fuel systems.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
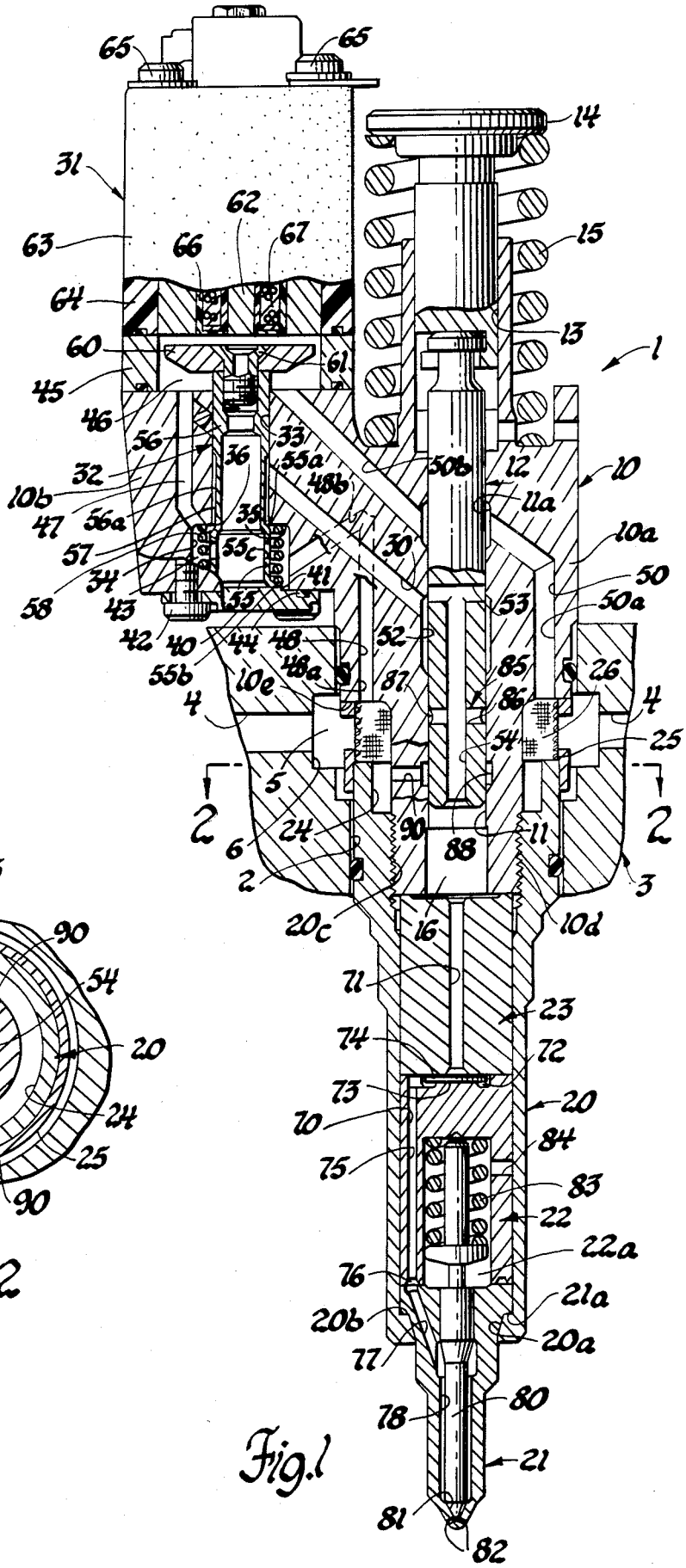
FIG. 1 is a sectional view of a portion of a diesel engine with an electromagnetic unit fuel injector in accordance with a preferred embodiment of the invention mounted in the cylinder head thereof, the injector being shown in elevation with elements thereof being shown so that the plunger of the pump thereof is positioned at near the beginning of a pump stroke and with the electromagnetic valve means thereof deenergized, and with parts of the unit shown in elevation.

Referring first to FIG. 1, an electromagnetic unit injector, generally designated 1, constructed in accordance with a preferred embodiment of the invention is adapted to be mounted, for example, in a suitable bore or injector socket 2 provided for this purpose in the cylinder head 3 of a diesel engine so that the lower spray tip end of the injector projects from the cylinder head 3 for the discharge of fuel into the associate combustion chamber, not shown.

The electromagnetic unit fuel injector 1 is, in effect, a unit fuel injector-pump assembly with an electromagnetic actuated, normally open control valve incorporated therein to control fuel discharge from the injector portion of this assembly in a manner to be described.

In the construction illustrated, the electromagnetic unit fuel injector 1 includes an injector body 10 which is defined by a vertical main body portion 10*a* and an integral side body portion 10*b*. The body portion 10*a* is provided with a vertical extending stepped bore therethrough to provide a lower cylindrical wall defining a cylinder or bushing 11 of an internal diameter to slidably and sealingly receive a pump plunger 12 and an upper wall 13 of a larger internal diameter than that defining the bushing. An actuator follower 14 is operatively connected to the upper outboard portion of the plunger 12, whereby it and the plunger thus operatively connected thereto are adapted to be reciprocated, for example by an engine driven camshaft 7, push rod 8 and rocker arm 9, in a known manner as schematically shown, for example, in FIG. 3. A plunger return spring 15 is operatively connected to the plunger 12 to normally bias it in a suction stroke direction.

The pump plunger 12 forms with the bushing 11 a variable volume pump chamber 16 at the lower open end of the bushing 11.

In a conventional manner, a nut 20 is threaded to the lower end of the body 10 to form an extension thereof. Nut 20 has an opening 20*a* at its lower end through which extends the lower end of a combined injector valve body or spray tip 21, hereinafter referred to as the spray tip, of a conventional fuel injection nozzle assembly. As shown, the spray tip 21 is enlarged at its upper end to provide a shoulder 21*a* which seats on an internal shoulder 20*b* provided by the through counterbore in nut 20. Between the spray tip 21 and the lower end of the injector body 10 there is positioned, in sequence starting from the spray tip, a spring cage 22, and a director cage 23, these elements being formed, in the construction illustrated, as separate elements for ease of manufacturing and assembly.

Nut 20 is provided with a stepped bore therethrough so as to define an internal upper wall 24 of predetermined internal diameter and next adjacent to this upper wall an internally threaded portion 20*c* for mating engagement with the external threads 10*d* at the lower reduced diameter end of body 10. This threaded interconnection between the injector body 10 and nut 20, in the construction shown, is arranged so that the upper end of the nut 20 is axially spaced apart from the radial shoulder 10*e* interconnecting the lower reduced diameter end of the body portion 10*a* to its upper enlarged diameter portion for a purpose to be described hereinafter. As well known, the threaded connection of the nut 20 to body 10 holds the spray tip 21, spring cage 22, and director cage 23 clamped and stacked end-to-end between the shoulder 20*b* of the nut 20 and the bottom face of body portion 10*a*. All of these above-described elements have lapped mating surfaces whereby they are held in pressure sealed relation to each other.

In the embodiment shown, the body portion 10*a* of the injector body 10 and nut 20 assembly is of stepped external configuration whereby it is adapted to be sealingly mounted in the injector socket 2, the arrangement being such whereby fuel can be supplied to and drained from the subject injector via an internal fuel rail or gallery means suitably provided for this purpose in the cylinder head 3, in a manner known in the art. In the construction shown in FIG. 1, the cylinder head 3 is provided with a single flow through fuel passage 4 which serves as both a fuel supply passage and a drain passage to and from the injector 1, this fuel passage 4 being located so as to be in flow communication with an annular shaped cavity 5 defined by a stepped annular groove 6 provided for this purpose in the socket 2 of the cylinder head 3.

Figure 3:
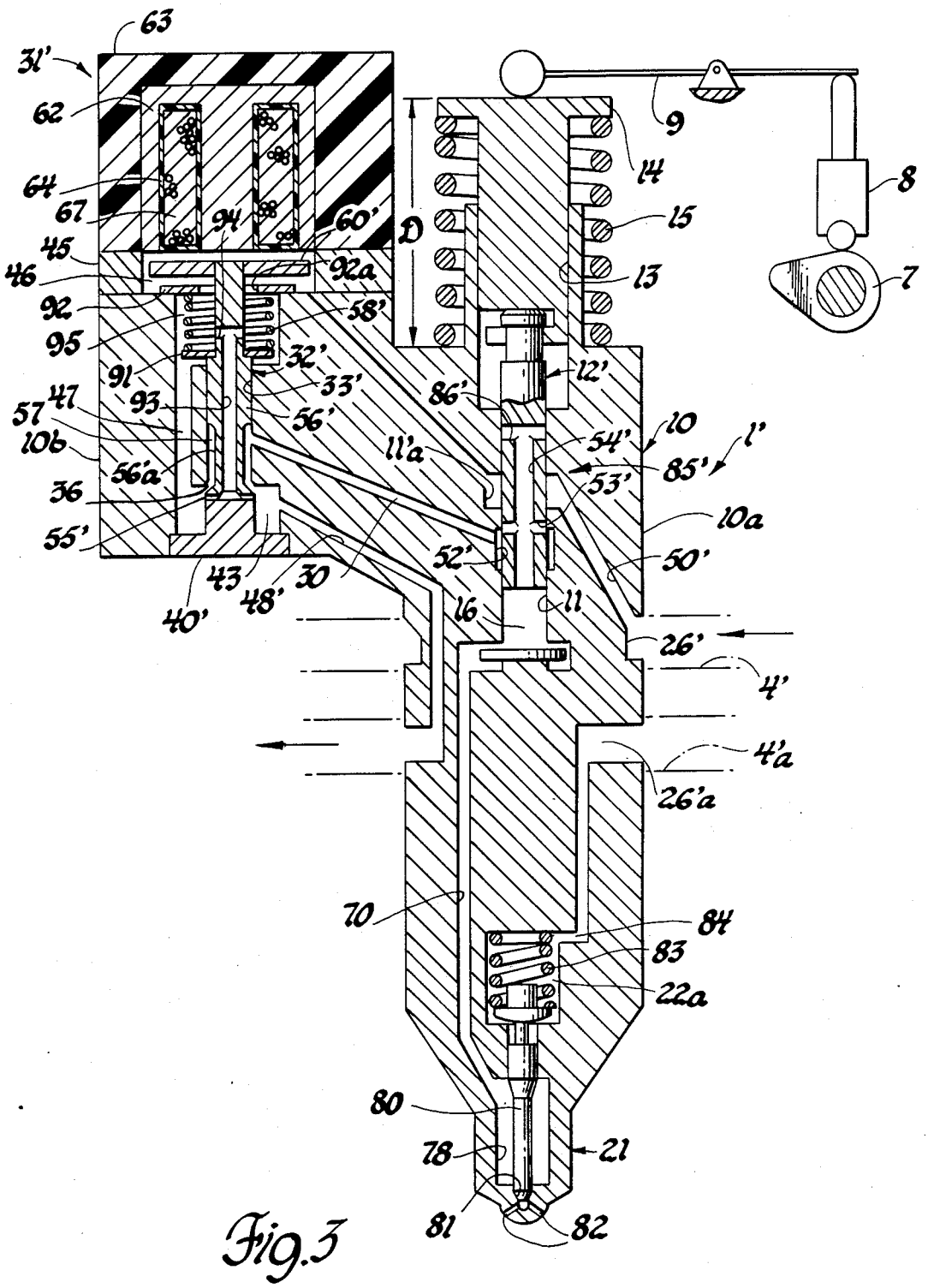

Alternatively, as is well known in the fuel injection art, separate fuel passages, located in axial spaced apart relationship to each other can be used, if desired, to permit one of the passages to serve essentially as a supply passage to an injector and the other passage to serve as a drain passage from the injector in the manner shown schematically for the alternate embodiment injector shown in FIG. 3. Also, as well known, either a pressure regulator or a flow orifice, not shown, would be associated with such passage or passages, as described hereinabove, whereby to maintain the pressure in such passage or passages at a predetermined relatively low supply/drain pressure.

As illustrated in FIG. 1, an annular fuel filter 25 is positioned so that its lower end encircles the upper end of nut 20 and whereby its upper end is in abutment against shoulder 10*e* of injector body 10. Filter 25 and the internal upper wall 24 of nut 20, in effect, defines with the outer peripheral surface of the reduced diameter end of the body portion 10*a* a fuel supply/drain cavity 26 that is thus in fuel flow communication with cavity 5 via the flow opening through filter 25.

The basic flow of fuel to the pump chamber 16 and drain flow therefrom is by means of a supply/drain passage means 30 having the flow therethrough controlled by a solenoid, generally designated 31, actuated control valve 32 in a manner to be described in detail hereinafter.

For this purpose, the side body portion 10*b* is provided with a stepped bore therethrough to define circular internal walls including an upper valve stem guide wall 33 of predetermined internal diameter and a lower wall 34 of substantially larger internal diameter than that of guide wall 33, these walls being interconnected by a flat shoulder 35 that terminates with a small inclined wall defining an annular, conical valve seat 36 encircling guide wall 33.

In the construction illustrated, a closure cap 40 with a central upstanding boss 41 is suitably secured, as by screws 42, to the lower surface of the side body portion 10*b* so as to be concentric with lower wall 34 whereby to define with this wall 34 and shoulder 35 a supply/drain chamber 43. As shown, the boss 41 is of a predetermined height, as desired, to serve as a central valve 32 opening stop. An O-ring seal 44 positioned as in an annular groove provided for this purpose in the closure cap 40 effect a fluid seal between the closure cap and the flat bottom surface of the side body portion 10*b*. In addition, a hollow solenoid spacer 45, sealingly and suitably secured in sandwiched relationship between the lower surface of the solenoid 31 and the flat upper surface of the side body portion 10*b* in substantially encircling relationship to the valve stem guide wall 33 defines an armature cavity 46 that is in direct flow communication with the supply/drain chamber 43 by a pressure equalizing passage 47 that is radially offset relative to the axis of the bore defined by the bore forming the valve stem guide wall 33, all in a manner and for a purpqse similar to that shown in the above-identified U.S. Pat. No. 4,392,612.

Fuel is supplied to the supply/drain chamber 43 and drained therefrom by means of a primary supply/drain passage 48 that includes a vertical passage portion 48*a* in the main body portion 10*a* which at one end is in flow communication with supply/drain cavity 26 and which at its opposite end communicates with the upper end of an inclined passage portion 48*b*, the lower end of which opens through wall 34 into the supply/drain chamber 43. In addition, fuel can be supplied to the armature chamber 46 and drained therefrom by means of a secondary supply/drain passage 50 which includes a first passage portion 50*a*, which at one end is in flow communication with an annular groove 11*a* in bushing 11, and an inclined second passage portion 50*b* extending from the annular groove 11*a* to open through the upper surface of the side body portion 10*b* into the armature chamber 46.

The actual ingress and egress of fuel to the pump chamber 16 is by means of the inclined supply/drain passage 30 provided in body 10, with the lower end of this passage 30 opening into an annular groove 52 provided in bushing 11 while the upper end thereof opens through the valve stem guide wall 33 in the side body portion 10*b*.

Actual flow communication between this passage 30 and its associate groove 52 with the pump chamber 16 is by means of at least one through radial passage 53 and an interconnecting axial passage 54 provided in the lower end of plunger 12.

In addition, flow between the supply/drain chamber 43 and passage 30 is controlled by the solenoid 31 actuated control valve 32.

The control valve 32, in the form of a hollow poppet valve, includes an axially elongated head 55 having a conical valve seat surface 55*a* at one end thereof, the upper end with reference to FIG. 1, a spring engaging, outward extending, radial flange 55*b* at its opposite or lower end and at least one radial passage 55*c* through the wall of the head intermediate these ends and a stem 56 extending upward therefrom. The stem 56 includes an upper portion of a diameter to be reciprocably received in the valve stem guide wall 33 and a lower portion 56*a* of reduced diameter next adjacent to the valve seat surface 55*a* of head 55 having an axial extent so as to form with the valve stem guide wall 33 an annulus cavity 57 that is in communication with passage 30 during opening and closing movement of the control valve 32

Control valve 32 can have its valve seat surface 55*a* configured relative to valve seat 36 whereby it will operate substantially as a pressure balanced valve in the manner as disclosed in the above-identified U.S. Pat. No. 4,392,612 or as an unbalanced pressure valve in the manner as disclosed in the above-identified U.S Pat. No. 4,463,900, as desired Control valve 32 is normally biased to an open position relative to the valve seat 36, the position shown in FIG. 1, by means of a spring 58, of predetermined force, that loosely encircles the main body portion of the valve head 55 and that has one end thereof in abutment against the radial flange 55*b* of the valve head. Movement of the control valve 32 to a valve closed position against the valve seat 36 by means of a solenoid 31 actuated flat armature 60 that is loosely received in the armature cavity 46 and which is suitably secured to the upper valve stem 56 end of the control valve 32, as by means of a hollow screw 61 threadingly engaged in the internally threaded upper free end of the valve stem 56.

As seen in FIG. 1, the armature 60 is thus loosely received in the complementary shaped armature cavity 46 provided in a solenoid spacer 45 for movement relative to an associate pole piece 62 of the solenoid assembly 31.

The solenoid assembly 31 further includes a stator assembly, generally designated 63, having a flanged inverted cup-shaped solenoid case 64, made for example, of a suitable plastic such as glass filled nylon, which is secured as by screws 65 to the upper surface of the side body portion 10*b*, with the solenoid spacer 45 sandwiched therebetween, in position to encircle the valve stem guide wall 33. A coil bobbin 66, supporting a wound solenoid coil 67 and, a segmented multi-piece pole piece 62 are supported within the solenoid case 64.

In the construction illustrated, the lower surface of the pole piece 62 is aligned with the lower surface of the solenoid case 64, as shown in FIG. 1. With this arrangement, the thickness of the solenoid spacer 45 is preselected relative to the height of the armature 60 above the upper surface of the side body portion 10*b*, when control valve 32 is in its closed position, so that a clearance exists between the upper working surface of the armature and the plane of the upper surface of the solenoid spacer whereby a minimum working air gap will exist between the opposed working faces of the armature and pole piece.

As would be conventional, the solenoid coil 67 is adapted to be connected to a suitable source of electrical power via a fuel injection electronic control circuit, not shown, whereby the solenoid coil can be energized as a function of the operating conditions of an associated engine in a manner well known in the art.

During operation, on a pump stroke of plunger 12, pressurized fuel is adapted to be discharged from pump chamber 16 into the inlet end of a discharge passage means 70 to be described next hereinafter.

An upper part of this discharge passage means 70, with reference to FIG. 1, includes a vertical passage 71 extending through director cage 23 for flow communication with an annular chamber 72 provided in the upper surface of the spring cage 22

As shown, the spring cage 22 is provided with the enlarged chamber 72 formed therein so as to face the bottom of director cage 23 and, projecting upwardly from the bottom of the chamber is a protuberance 73 which forms a stop for a circular flat disc check valve 74 used for a purpose well known in the art.

At least one vertical passage 75 is provided in the spring cage 22 to connect the chamber 72 with an annular groove 76 in the lower end of spring cage 22. This lower groove 76 is, in turn, connected by at least one inclined passage 77 to a central passage 78 surrounding a needle type injection valve 80 movably positioned within the spray tip 21. At the lower end of passage 78 is an outlet for fuel delivery with an encircling annular conical valve seat 81 for the needle valve 80 and, below the valve seat 81 are connecting spray orifices 82 in the lower end of the spray tip 21.

Injection valve 80 is a conventional type pressure actuated valve that is normally biased by a spring 83 operatively positioned in a suitable cavity 22*a*, in the spring cage 22, to a valve closed position, the cavity 22*a* being vented by means of a radial vent port 84 to a relatively low pressure fuel area in a conventional manner well known in the art.

The electromagnetic unit fuel injector 1 as thus far described is similar in construction and function as those disclosed in the above-identified U.S. Pat. Nos. 4,392,612 and 4,463,900. Thus during engine operation, fuel is supplied at a predetermined supply pressure by a pump, not shown, to the injector 1 via the fuel passage 4 and cavity 5 in cylinder head 3 and through the filter 25 into the supply/drain cavity 26. Fuel thus supplied to the supply/drain cavity 26 can flow through passage 48 into the supply/drain chamber 43 and from this chamber 43 it can flow via the pressure equalizing passage 47 and also through the ports 55*c* and hollow control valve 32 and screw 61 into the armature cavity 46. In the construction shown in FIG. 1, fuel can also flow in either direction between the armature cavity 46 and the supply/drain cavity 26 via the drain passage 50.

With the solenoid coil 67 of solenoid 31 deenergized, the valve spring 58 will be operative to open and hold open the control valve 32 relative to the valve seat 36 and, of course, the armature 60 is thus positioned with a predetermined working air gap between its working surface and the opposed working surface of the pole piece 62.

Thus during a suction stroke of the plunger 12, with the control valve 32 then in its open position, fuel can now flow from the supply/drain chamber 43 through the annulus passage now defined between the valve seat surface 55*a* and valve seat 36 into the cavity 57 defined by the reduced diameter valve stem portion 56*a* and valve stem guide wall 33 and then via passage 30 into the cavity defined by groove 52 and then through passages 53 and 54 into the pump chamber 16. At the same time, fuel will be present in the discharge passage means 70 used to supply fuel to the injection nozzle assembly.

Thereafter, as the follower 14 is driven downward as by the rocker arm 9 as shown in FIG. 3, to effect a pump stroke of the plunger 12, that is downward movement of the plunger 12 with reference to FIG. 1, this downward pump stroke movement of the plunger will cause pressurization of the fuel within the pump chamber 16 and of course of the fuel in the passages 30 and the discharge passage means 70 associated therewith. However, with the solenoid coil 67 still deenergized, this pressure can only rise to a level that is a predetermined amount less than the "pop" pressure required to lift the needle valve 80 against the force of its associate return spring 83.

During this period of time, the fuel displaced from the pump chamber 16 can flow via the passage 30 and the cavity 57 back to the supply/drain chamber 43 since the control valve 32 is still open.

Thereafter, during the continued downward stroke of the plunger 12, an electrical (current) pulse of finite character and duration (time relative for example to the top dead center of the associate engine piston, not shown, position with respect to the camshaft and rocker arm linkage) applied through suitable electrical conductors to the solenoid coil 67 produces an electromagnetic field attracting the armature 60 upward, from the position shown in FIG. 1, toward the pole piece 62.

This movement of the armature 60 as coupled will effect seating of the control valve 32 against its associate valve seat 36. As this occurs, the drainage of fuel from the pump chamber 16 via passage 30 in the manner described hereinabove will no longer occur. Without this spill of fuel from the pump chamber 16, the continued downward movement of the plunger 12 will increase the pressure of fuel therein to a "pop" pressure level to effect unseating of the needle valve 80. This then permits the injection of fuel out through the spray orifices 82. Normally, the injection pressure continues to build up during further continued downward movement of the plunger 12.

Ending the application of electrical current pulse to the solenoid coil 67 causes the electromagnetic field to collapse. As this occurs, the force of the valve spring 58 causes immediate unseating of the control valve 32 so as to allow spill fuel flow from the pump chamber 16 via the passages including passage 30 back to the supply/-drain chamber 43. This spill flow of fuel thus releases the injection nozzle system pressure as in the discharge passage means 70 so that the spring 83 can again effect seating of the injection valve 80.

Now in accordance with the invention, a mechanical spill port passage means is incorporated into the electromagnetic unit fuel injector 1 so as to assist the solenoid 31 actuated control valve 32 in spilling injection pressure at a predetermined high engine operating speed, this spill passage means thus, in effect, operates as a secondary spill passage means only during such high speed engine operation.

Figure 2:
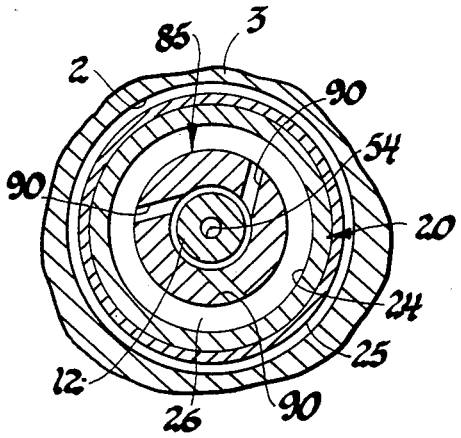
FIG. 2 is a sectional view taken along line 2—2 of FIG. 1 showing the spill port arrangement of the electromagnetic unit fuel injector of FIG. 1; and, FIG. 3 is a longitudinal schematic sectional view of an alternate embodiment fuel injector constructed in accordance with the invention and of the mechanism for effecting the operation thereof.

In the embodiment shown in FIGS. 1 and 2, this secondary spill port passage means, generally designated 85, includes at least one radial through port passage 86 in the plunger 12 that intersects the axial passage 54 therein, with the other end of the port passage 86 opening into an annular groove 87 formed in the outer peripheral surface of the plunger In addition the cylinder or bushing 11 in the reduced diameter end of the main body portion 10*a* is provided with an annular groove 88 that is in flow communication with plural radial, through spill ports 90 opening into the supply/-drain cavity 26, three such spill ports 90 being used in the construction shown, as best seen in FIG. 2. As shown in FIG. 2, the spill ports 90 are preferably spirally arranged so as to discharge pressurized fuel in a swirl pattern into the supply/drain cavity whereby to reduce cavitation so that the pressurized fuel will not impinge at right angles to the wall 24 of nut 20.

The lower edge of the annular groove 87 on the plunger 12 is located a predetermined axial distance from the upper surface of the plunger 12 and the upper edge of the annular groove 88 in the wall of cylinder 11 is also axially located so that during a pump stroke, the plunger 12 will travel a predetermined axial distance before initial uncovering of those associate elements of the secondary spill port passage means will occur.

This secondary spill port passage means 85 is thus located, as desired for a particular injector engine application so that fuel injection can always be mechanically controlled after a predetermined plunger 12 pump stroke length. That is, the secondary spill port passage means 85 is operatively positioned so as to spill injection pressure at the point fuel can no longer be effectively added to the combustion process in the associate engine cylinder in a particular engine. Some flexibility of the spill timing by means of this secondary spill port passage means 85 can be maintained through the preselected injector timing dimension which is set during injector installation in a manner and for a purpose well known in the art. Thus at maximum injector output and at a predetermined high engine speed, the secondary spill port passage means 85 is located so that it and the control valve 32 will open at the same time so as to provide an effectively large spill path whereby to rapidly dissipate injection pressure to thus end the injection event quickly It will be appreciated by those skilled in the art that, due to the nature of the combustion cycle of a diesel engine at lower engine speeds, the required end of injection would always occur before the above-described secondary, spill port passage means 85 would be uncovered. Therefore, the electromagnetic unit fuel injector 1 would, in effect, be totally electronically controlled at lower engine speeds, and both electronically and mechanically controlled at high engine speeds, that is with the additional spill flow area of the spill port passage means 85 being only used when it is needed, that is, at predetermined high engine speeds and injector outputs.

An alternate embodiment of an electromagnetic unit fuel injector, generally designated 1', which utilizes the principles of the present invention is schematically shown in FIG. 3, wherein similar parts are designated by similar numerals, but with the addition of a prime (') where deemed necessary.

In the construction shown in FIG. 3, this injector 1' is adapted to be mounted in the cylinder head of an engine which is provided with separate supply and drain fuel passages 4' and 4'*a*, respectfully, which are in flow communication with separate supply/drain cavities 26' and 26'*a*, respectively. Accordingly, in this embodiment, the passage 50', previously described as a secondary supply/drain passage with reference to the FIG. 1 embodiment, may be considered to serve as the primary supply/drain passage since it now communicates with the supply passage 4' while the passage 48', previously described as the primary supply/drain passage now may be considered as the secondary supply/drain passage because of its direct flow communication with the drain passage 4'*a*.

The plunger 12' in the alternate FIG. 3 embodiment has the radial passages 53' intersecting the axial blind bore 54' in the plunger at the lower end thereof and, accordingly the annular groove 52' which communicates with the lower end of passage 30 is formed in the lower end of the cylinder or bushing 11 wall closely adjacent to the pump chamber 16.

As in the previously described embodiment, flow through the passage 30 is controlled by a solenoid 31' actuated control valve 32' in the form of a hollow poppet type valve having a head 55' adapted to seat against valve seat 36 and a stem 56' slidably guided in the valve stem guide wall 33'. A portion 56'*a* of the stem 56' next adjacent to the head 55' is of reduced diameter and of an axial extent so as to define the annulus cavity 57 which is always in flow communication with passage 30 during opening and closing movement of the control valve 32'.

The control valve 32' is normally biased in a valve opening direction, downward with reference to FIG. 3 to the position shown, by means of a coiled valve spring 58' loosely encircling an intermediate upper reduced diameter end portion of the valve stem 56', with one end of the spring in abutment against a washer like spring retainer 91 on the control valve 32' and its other end in abutment against a spring retainer 92 suitably secured to the upper surface of the side body portion 10*b* concentric with the valve stem guide wall 33'. The upper free end of the valve stem 56' extends loosely through a central aperture 92*a* in the spring retainer 92 and has an armature 60' suitably fixed thereto.

In addition, the control valve 32', in the construction shown in FIG. 3, is provided with a blind bore 93 which extends from the head 55' up into stem 56' so as to intersect with at least one radial passage 94 that opens into the cavity 95 in which the valve spring 58' is loosely received. Accordingly, in the construction shown, the pressure equalizing passage 47 effects flow communication between the supply/drain chamber 43 and the armature cavity 46 via the cavity 95 and the aperture 92*a* in the spring retainer 92.

In the embodiment shown in FIG. 3, the supply/drain passage 50' also serves as part of a spill port passage means 85' which accordingly includes at least one radial spill port passage 86' located so as to intersect the upper end of the axial passage 54' in the plunger 12' and is axially located on the plunger so as to come into flow communication with the annulus defined by the annular groove 11'a in the wall of bushing 11 after a predetermined extent of travel of the plunger 12' during a pump stroke.

Functional Description

As the camshaft 7 rotates in a clockwise direction with reference to FIG. 3, the push rod 8 is moved upward thus pivoting the rocker arm 9 in a direction so as to drive the plunger 12' downward on a pump stroke so as to pressurize the fuel within the pump chamber 16 and in the associated passages 30 and 70. However, with the solenoid coil 67 deenergized, this pressure can only rise to a predetermined level less than the "pop" pressure required to lift the injection valve 80 against the force of its associate return spring 83 because of the spill flow past the then open control valve 32'.

An electrical pulse is sent to the solenoid coil 67 at a predetermined time and for a predetermined duration so as to effect closure of the control valve 32', thus trapping fuel in the pump chamber 16 and, in effect, in the discharge passage means 70. Thus as the plunger 12' continues downward on its pump stroke, the fuel pressure increases until the injection valve 80 opening pressure is reached at which time the injection valve 80 "pops" open to begin the injection of fuel into the combustion chamber of the associate engine cylinder, not shown. Injection then continues until either the electrical signal to the solenoid coil 67 is shut off, that is, the solenoid assembly 31' becomes deenergized so as to allow opening of the control valve 32' by valve spring 58', in the manner as previously described with reference to the conventional elements of the FIG. 1 injector embodiment, or the spill port passage 86' and the spill annulus (groove 11'a) overlap.

When either event occurs, the high pressure fuel in the pump chamber 16 is spilled, which lowers the pressure in the pump chamber 16 and also in the discharge passage means 70 so as to end the injection event by the closing of injection valve 80. The timing of the mechanical spill event can be somewhat controlled by the proper set of the timing dimension D in a known manner so that this event and the deenergization of the solenoid coil 67 will occur at substantially the same time and above a predetermined high engine operating speed. Of course, the arrangement is such that the plunger 12' continues to move downward until maximum associate cam lift on the camshaft 7 is reached, with the fuel thus displaced spilling or flowing through the open control valve 32' and through spill port passage 86' and associate spill passage means. As the camshaft 7 continues to rotate so that the push rod 8 will then again ride on the base circle of the associate cam, the spring 15 will effect a suction stroke of the plunger 12' whereby fuel can then flow via the open control valve 32' and also through the spill port passage means until the radial spill port passage 86' moves upward past the upper edge of the annular groove 11'a in the FIG. 3 embodiment to again fill the pump chamber 16 for the next cycle.

It will be apparent that the embodiment of the injector 1 of FIG. 1 will function in a similar manner to that as described hereinabove with reference to the FIG. 3 embodiment.

Thus from the above description of the invention it will now become apparent that the mechanical spill port means of the invention provides in an otherwise conventional electromagnetic unit fuel injector, the means to effect the end of the injection event quickly at a predetermined high engine speed so as to improve engine performance and reduce exhaust emissions at high engine speeds while still retaining the spill, inject, spill flexibility offered by electronic control of the basic electromagnetic unit fuel injector.

In addition to the above better spill arrangement at high engine speeds, the secondary spill port passage means of the invention as incorporated into an electromagnetic unit fuel injector offers other advantages. For example, injector durability will be improved because the control valve 32 or 32' and the secondary spill port passage means in accordance with the invention will share the injector pump fill and spill cycles thus minimizing any erosion that may occur from fuel flow. In addition, the reduced fuel flow past the control valve will also improve its stability at all engine speeds.

While the invention has been described with reference to the structure disclosed herein, it is not confined to the details set forth, and this application is intended to cover such modifications or changes as may come within the purposes of the improvement or scope of the following claims.

The embodiments of the invention in which an exclusive property or privilege is claimed are defined as follows:

1. In an electromagnetic unit fuel injector, for injecting fuel into the combustion chamber of an engine, the injector being of the type that includes a housing means having at one end thereof a cylinder with an externally actuated plunger reciprocable therein between a suction stroke and a pump stroke and defining with the cylinder a pump chamber open at one end and the housing means having a spray discharge means at its opposite end, a supply/drain passage means in said housing means with one end thereof in flow communication with said pump chamber and its opposite end being connectable to a source of fuel at a predetermined supply pressure with flow therethrough controlled by a solenoid actuated control valve means, a discharge passage means in said housing means effecting flow communication between said pump chamber and said spray discharge means and, a pressure actuated injector valve means operatively positioned in said housing means to control flow discharge from said spray discharge means, the improvement wherein: said housing means further includes a spill passage means therein having one end thereof in flow communication with said supply/drain passage means and having its other end defining a spill annulus means opening into said cylinder at a predetermined axial extent from the open end of said pump chamber and wherein said plunger is provided with a spill port means in flow communication at one end with said pump chamber and at its other end is adapted to come into flow communication with said spill annulus after a predetermined pump stroke of said plunger whereby said spill passage means and said spill port means will be operative to assist the solenoid actuated control valve means to effect the rapid spill of injection pressure at a predetermined injector output and engine operating speed above which fuel can no longer be effectively added to the combustion process in the combustion chamber.

2. In an electromagnetic unit fuel injector, for injecting fuel into the combustion chamber of an engine, the fuel injector being of the type that includes a housing means having at one end thereof a cylinder with an externally actuated plunger reciprocable therein between a suction stroke and a pump stroke and defining with the cylinder a pump chamber open at one end and having a spray discharge means at its opposite end, a supply/drain passage means in said housing means with one end thereof in flow communication with said pump chamber and its opposite end being connectable to a source of fuel at a predetermined supply pressure with flow therethrough controlled by a solenoid actuated control valve means, a discharge passage means in said housing means effecting flow communication between said pump chamber and said spray discharge means and, a pressure actuated injector valve means operatively positioned in said housing means to control flow discharge from said spray discharge means, the improvement wherein: said housing means includes a spill passage means therein having one end thereof in flow communication with said supply/drain passage means and having its other end defining a spill annulus opening into said cylinder at a predetermined axial extent from the open end of said fuel chamber and wherein said plunger is provided with a spill port means including an axial passage and an intersecting radial spill port means in said plunger with said axial passage being in flow communication at one end with said pump chamber and said spill port means being axially located on said plunger whereby said spill port means will come into flow communication with said spill annulus after a predetermined pump stroke of said plunger whereby said spill passage means and said spill port means will be operative to assist the solenoid actuated valve to effect the rapid spill of injection pressure at a predetermined engine operating speed.

3. In an electromagnetic unit injector, for injecting fuel into the combustion chamber of an engine, of the type that includes a housing means having at one end thereof a cylinder with an externally actuated plunger reciprocable therein between a suction stroke and a pump stroke and defining with the cylinder a pump chamber open at one end and a spray discharge means at its opposite end, a supply/drain passage means in said housing means with one end thereof in flow communication with said pump chamber and its opposite end being connectable to a source of fuel at a predetermined supply pressure with flow therethrough controlled by a solenoid actuated control valve, a discharge passage means in said housing means effecting flow communication between said pump chamber and said spray discharge means and, a pressure actuated injector valve means operatively positioned in said housing means to control flow discharge out through said spray discharge means, the improvement wherein: said housing means includes a spill passage means therein having one end thereof in flow communication with said supply/drain passage means and having its other end defining a spill annulus opening into said cylinder at a predetermined axial location and wherein said plunger is provided with a spill port passage means having one end thereof in flow communication with said pump chamber and having its other end axially located so as to come into flow communication with said spill annulus after a predetermined pump stroke of said plunger whereby said spill passage means and said spill port passage means will be operative to assist the solenoid actuated control valve to effect the rapid spill of injection pressure after a predetermined length of travel of said plunger on said pump stroke and to also permit the ingress of fuel into said pump chamber during part of the suction stroke of said plunger.

* * * * *